US006220430B1

(12) United States Patent
Boriani et al.

(10) Patent No.: US 6,220,430 B1
(45) Date of Patent: Apr. 24, 2001

(54) RIGID WRAPPER WITH HINGED LID FOR TOBACCO PRODUCTS

(75) Inventors: Silvano Boriani, Bologna; Alessandro Minarelli, Bazzano, both of (IT)

(73) Assignee: G.D S.p.A., Bologna (IT)

( * ) Notice: Subject to any disclaimer, the term of this patent is extended or adjusted under 35 U.S.C. 154(b) by 0 days.

(21) Appl. No.: 09/549,065

(22) Filed: Apr. 13, 2000

(30) Foreign Application Priority Data

Apr. 16, 1999 (IT) ..... BO99A0181

(51) Int. Cl.[7] ..... B65D 85/10; A24F 15/00

(52) U.S. Cl. ..... 206/268; 206/273; 206/271; 206/265; 206/229; 206/160.1

(58) Field of Search ..... 206/273, 271, 206/268, 265; 229/160.1

(56) References Cited

U.S. PATENT DOCUMENTS 5,358,105 10/1994 Boriani et al. .

FOREIGN PATENT DOCUMENTS 1 078 934 3/1960 (DE) .
0 706 957 4/1996 (EP) .
819204 9/1959 (GB) .
1 462 915 1/1977 (GB) .

*Primary Examiner*—Paul T. Sewell
*Assistant Examiner*—Troy Arnold
(74) *Attorney, Agent, or Firm*—Pillsbury Winthrop LLP

(57) ABSTRACT

A rigid wrapper for tobacco products comprises a cupped container and a similarly cupped lid hinged together along respective rear edges, also a reinforcing frame located partly inside the container and fixed to a front face and to two flank faces of the container. The wrapper is fashioned from a substantially rectangular diecut blank with a predominating longitudinal axis, which incorporates a main portion providing the container and the lid and a longitudinal appendage providing the frame; the appendage is essentially U-shaped, hinged by two arms to two lateral panels of the blank providing respective flanks of the wrapper, and circumscribes a free longitudinally-extended extremity of the main portion shaped and creased to include a panel providing a bottom of the wrapper, also two side flaps and a longitudinal end flap functioning as bottom end folds.

15 Claims, 6 Drawing Sheets

RIGID WRAPPER WITH HINGED LID FOR TOBACCO PRODUCTS

BACKGROUND OF THE INVENTION

The present invention relates to a rigid wrapper with a hinged lid for tobacco products.

Concerning tobacco products, explicit reference is made throughout the specification to articles such as cigarettes, cigars and the like, albeit with no limitation in scope implied.

In general, a cigarette packet of the rigid type with a hinged lid appears substantially as a box like wrapper of rectangular parallelepiped shape, proportioned to accommodate an ordered group of cigarettes enveloped by an inner wrapper normally of metal foil paper.

The rigid wrapper comprises a container of cupped embodiment surmounted by a similarly cupped lid hingedly attached to a rear edge of the container and rotatable thus between positions in which the container is open and shut, respectively. The rigid wrapper will normally present a top face, a bottom face, a rear face appearing as a continuous panel divided into two parts by a transverse hinge crease along which the lid is connected to the container, also a front face composed of two separate portions coinciding respectively with the front face of the container and the front face of the lid, and two flank faces each composed of two separate portions coinciding respectively with a flank face of the container and a flank face of the lid.

The container and the lid are fashioned typically by bending a single flat diecut blank of paperboard or similar material to the requisite shape.

Rigid wrappers of the type mentioned are provided usually with a reinforcing frame also of paperboard or similar material, part of which is positioned inside the container and disposed in contact with the relative front face and flank faces.

The portion of the frame that projects from the container functions as a supporting and restraining element for the lid when in the closed position.

It is conventional practice to manufacture rigid wrappers of the type described above on packaging machines by which the cigarettes are ordered first into groups, whereupon the groups are directed onto a first section of a packaging line and enveloped each in the relative wrapper of metal foil paper.

Thereafter, the groups of cigarettes advance to a station at which the frames are applied. As each group passes into the station, a respective frame bent to assume a 'U' profile is associated with the metal foil paper wrapper and the resulting assembly then advances together with a relative blank onto a second section of the packaging line, along which the blank is folded around the assembly to fashion the container and hinged lid of the rigid wrapper and thus complete the packet of cigarettes.

It will be gathered from the above outline that the conventional packaging machines in question normally comprise two conveying lines synchronized one with the other, one for the blanks, the other for the frames.

In order to simplify the structure of packaging machines as described above, and in particular to allow of dispensing with the frame conveying line, prior art methods embrace the use of flat diecut blanks with a frame already incorporated, obtained by shaping and punching respective longitudinal sheets cut from a continuous strip of paperboard or similar material.

In particular, U.S. Pat. No. 5,358,105 teaches the use of a diecut blank illustrated for convenience in FIG. 1, of which a central panel A, corresponding to the front face of the rigid wrapper ultimately obtained, is connected longitudinally at one end B to a frame denoted C; more exactly, the end B in question coincides with a bottom front corner edge of the erected wrapper and is joined to the frame C by way of an intermediate panel D. The frame C is composed of a longitudinally disposed end panel E of the blank, and two wings F projecting on either side of the panel E in a Tee formation. In a blank of this design, the intermediate panel D is bent double along a median transverse crease line G to provide a bottom end fold, and the longitudinal end panel E flattened against and fixed to the inside surface of the central panel A.

The blank described above and indicated in FIG. 1 is somewhat costly in that it involves cutting a relatively long sheet from the continuous strip of paperboard.

The object of the present invention is to provide a rigid wrapper with a hinged lid fashioned from a flat diecut blank with integral frame, shaped and punched in such a manner as to be obtainable from a relatively short length of strip material and thus relatively economical.

SUMMARY OF THE INVENTION

The stated object is duly realized according to the invention in a rigid wrapper with hinged lid for tobacco products of the type presenting a front, a back, two flanks, a top and a bottom, comprising a container and a lid both of cupped embodiment hinged together along respective rear edges, also a reinforcing frame positioned partly inside the cupped container and secured thus to a front face and to two flank faces of the selfsame container; wherein the wrapper is fashioned from a flat diecut blank of substantially rectangular shape with a predominating longitudinal axis that comprises, arranged along the longitudinal axis, a main portion providing the container and the lid, and a longitudinal appendage providing the frame.

To advantage, the main portion of the diecut blank incorporates an end panel providing the back, a first intermediate panel providing the top, a central panel providing the front and two lateral panels providing the flanks of the wrapper, and the appendage is substantially U-shaped, appearing as two lateral arms and a transverse panel of which the arms are hingedly attached to the respective lateral panels of the main portion, and disposed in such a way as to circumscribe a free longitudinal extremity of the main portion that affords a second intermediate panel providing the bottom, and two side flaps and a longitudinal end flap functioning as end folds by which the bottom is secured.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 2:
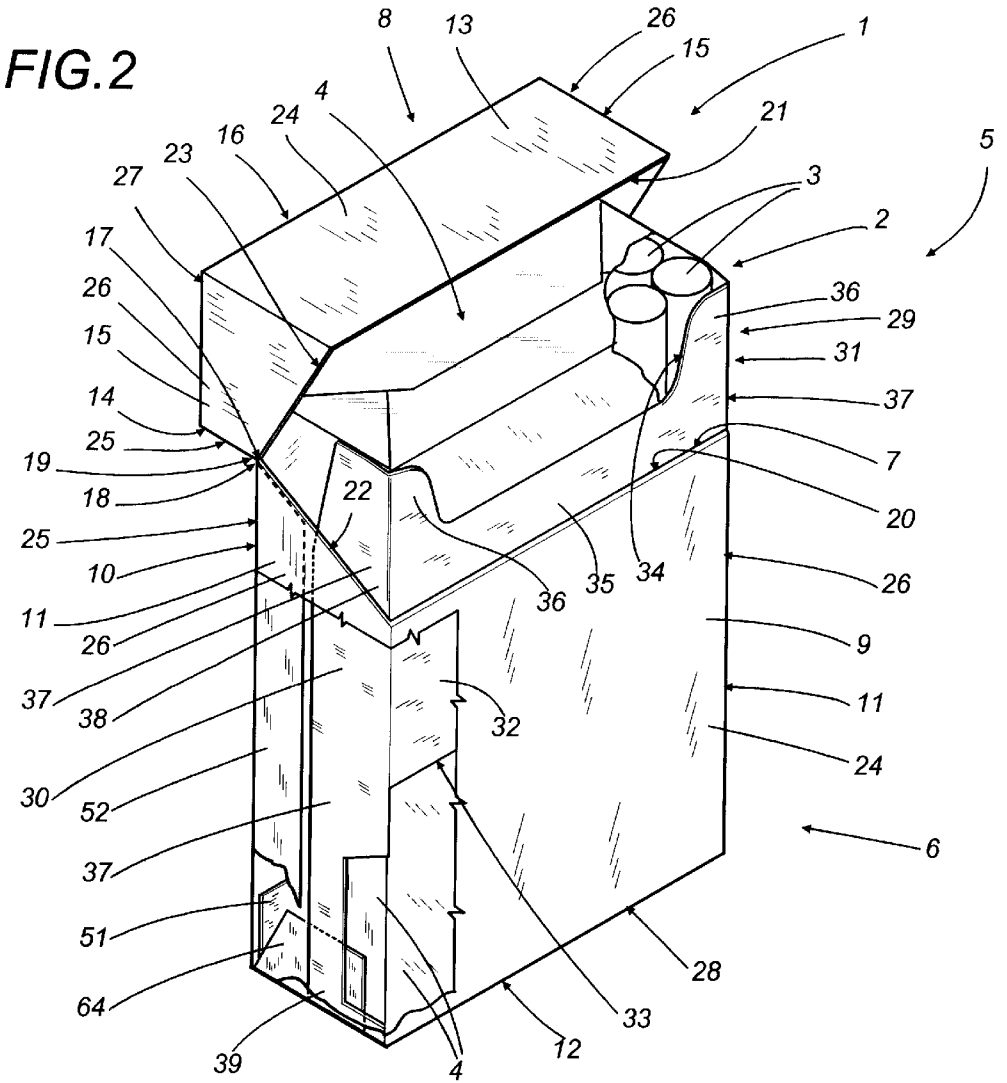
FIG. 2 illustrates a first embodiment of the rigid wrapper with hinged lid according to the present invention, viewed in perspective and with parts cut away for clarity.
Figure 5:
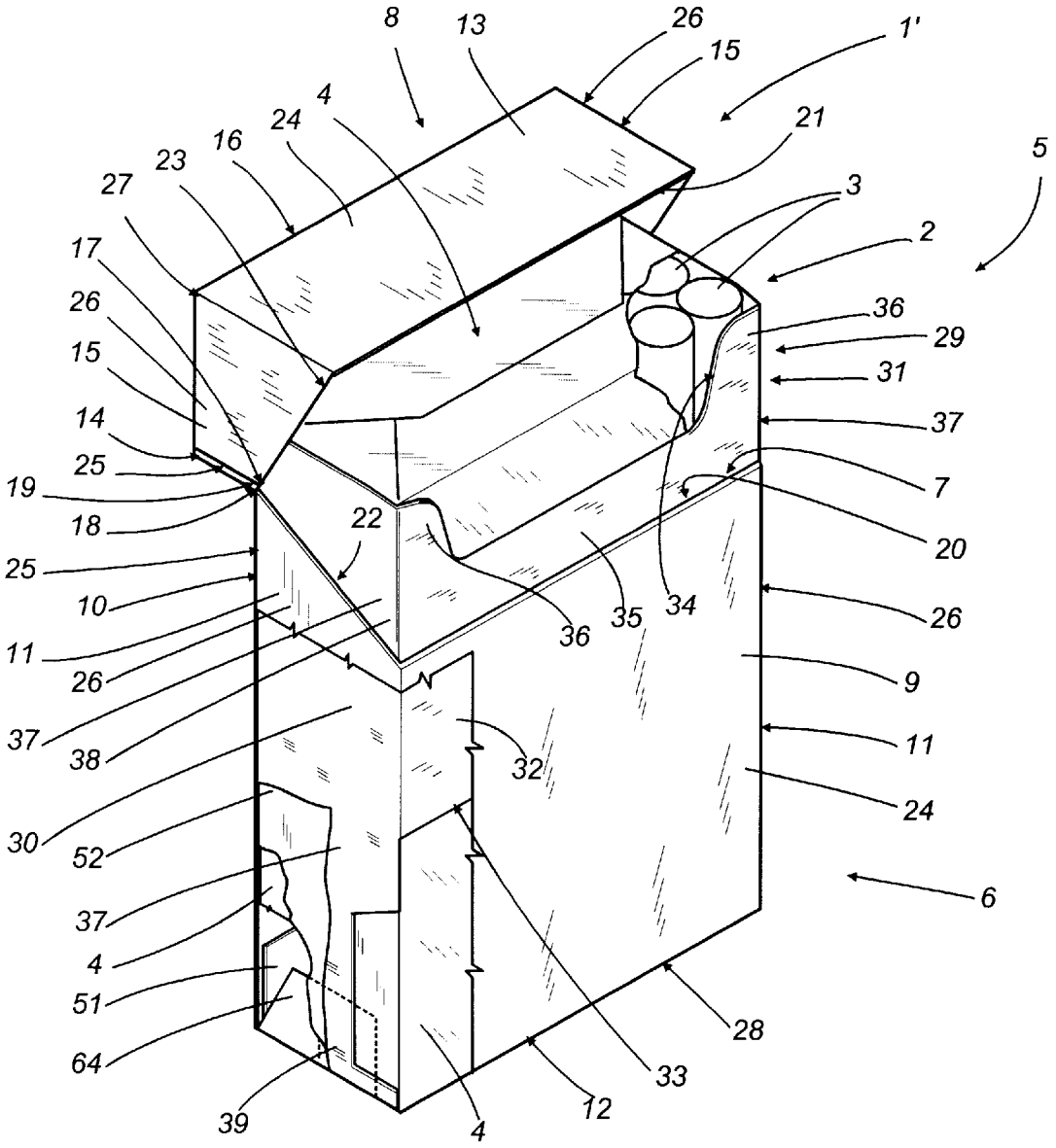
FIG. 5 illustrates a second embodiment of the rigid wrapper with hinged lid according to the present invention, viewed in perspective and with parts cut away for clarity.

Referring to FIGS. 2 and 5, respectively, 1 and 1' denote a rigid packet, in its entirety, containing an ordered group 2 of cigarettes 3 enveloped by a wrapper 4 of metal foil paper.

In each case the packet 1 and 1' includes a rigid external wrapper 5 of box construction appearing parallelepiped in shape, which in turn comprises a container 6 of cupped embodiment with an open top end 7 and, surmounting the container, a similarly cupped lid 8 attached hingedly to the container 6 and rotatable thus between a position in which the top end 7 is open (FIGS. 2 and 5) and a position in which the top end is closed (not illustrated).

The cupped container 6 presents a front face 9 and a rear face 10 mutually opposed and parallel, two mutually opposed and parallel flank faces 11 perpendicular to the front and rear faces 9 and 10, and an end face 12 disposed orthogonally to the front, rear and flank faces 9, 10 and 11.

The lid 8 presents a front face 13 and a rear face 14 mutually opposed and parallel, two mutually opposed and parallel flank faces 15 perpendicular to the front face 13 and the rear face 14, and an end face 16 orthogonal to the front, rear and flank faces 13, 14 and 15.

The rear faces 10 and 14 present corresponding joined edges 17 and 18 permanently associated one with another and combining to afford a transverse hinge crease 19 about which the lid 8 is rotatable between the open position and the closed position mentioned above, whilst the front faces 9 and 13 and the flank faces 11 and 15 present corresponding free edges 20, 21 and 22, 23 which combine when the lid 8 is in the closed position (not illustrated) to establish a line of separation between the lid 8 and the container 6.

The erected wrapper 5 presents a front 24 composed of the front faces 9 and 13, a back 25 composed of the rear faces 10 and 14, two flanks 26 composed each of a set of flank faces 11 and 15, a top 27 coinciding with the top end face 16 and a bottom 28 coinciding with the bottom end face 12.

Finally, the wrapper 5 incorporates a reinforcing frame 29, fixed to the container 6, which presents a portion 30 disposed internally of the container 6 and a remaining portion 31 that projects beyond the open top end 7 and functions thus as a supporting and restraining element for the lid 8 when in the closed position.

The frame 29 comprises a central breast piece 32 presenting a bottom edge 33 directed toward and disposed parallel with the bottom end face 12, and a top edge 34 essentially of 'U' outline directed toward the lid 8 and creating a central cutaway portion 35 with two lateral shoulders 36 extending away from the container 6. The breast piece 32 is fixed to the inside of the front face 9, from which the central portion 35 and the lateral shoulders 36 project together with two side pieces 37 fixed to the corresponding inside surfaces of the respective flank faces 11. The side pieces 37 each present one end 38 extending toward the lid 8 from the relative flank face 11 and an opposite end 39 that extends down to the bottom end face 12 of the container 6. The container 6, the lid 8 and the frame 29 of the wrapper 5 making up each of the packets 1 and 1' in FIGS. 2 and 5 are fashioned by folding relative flat diecut blanks 40 and 40', illustrated respectively in FIGS. 4 and 6, which are obtained by shaping and punching longitudinal sheets (not illustrated) cut from a continuous strip of paperboard or similar material (not illustrated).

In the interests of convenience, the illustrated parts of the blanks 40 and 40' will be referred to where possible in the description that now follows using the same numbers, primed, as those used to identify the corresponding faces of the wrapper 5.

Figure 1:
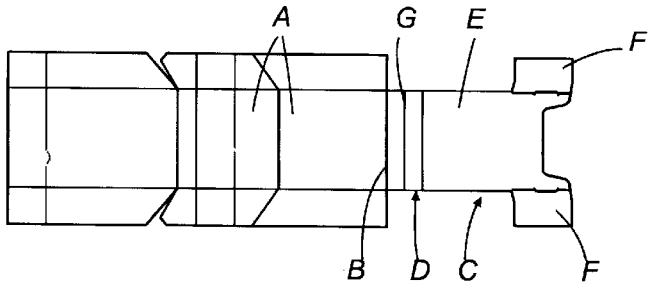
FIG. 1 illustrates the plan view of a diecut blank with integral frame of conventional type, used to manufacture a rigid wrapper with a hinged lid.
Figure 4:
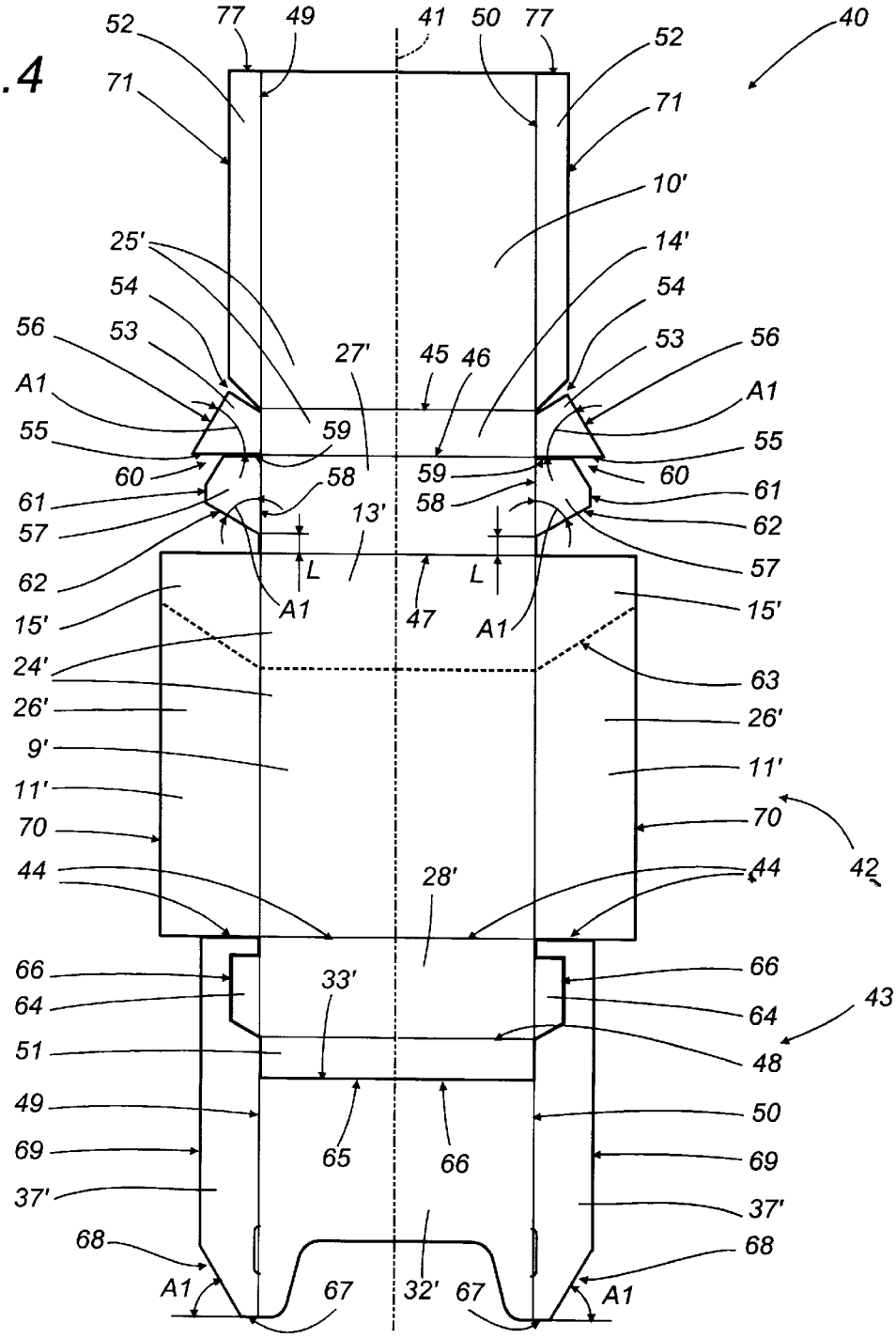
FIG. 4 shows a plan view of the diecut blank with integral frame used to manufacture the wrapper of FIG. 2.

The diecut blank 40 of FIG. 4 is substantially rectangular in shape, relative to a predominating longitudinal axis 41 substantially of symmetry, and is composed essentially of two parts arranged along the selfsame axis 41, namely a main portion 42 that will provide the container 6 and the lid 8, and a longitudinal appendage 43 providing the frame 29. The appendage 43 appears substantially 'U' shaped and is joined to the main portion 42 by way of two arms 37' hinged along two lateral end portions of a transverse crease line 44 extending perpendicular to the longitudinal axis 41.

The blank 40 also exhibits a plurality of further transverse crease lines denoted 45 . . . 48 extending parallel to the crease line 44 first mentioned, and two longitudinal crease lines 49 and 50 extending parallel to the axis 41. The longitudinal crease lines 49 and 50 combine with the transverse crease lines 44 . . . 48 to establish panels coinciding with the aforementioned faces of the container 6, the lid 8 and the frame 29.

More exactly, the transverse lines 44 . . . 48 serve to define a succession of panels compassed between the longitudinal lines 49 and 50: an end panel 25' extending from the line denoted 46 to the extremity remote from the appendage 43; a first intermediate panel 27' extending between two lines 46 and 47; a central panel 24' extending between two lines 47 and 44; a second intermediate panel 28' extending between two lines 44 and 48, also an end flap 51 extending from the line denoted 48 and terminating in a free edge 33' parallel to this same line 48.

The line denoted 45 coincides with the transverse hinge line 19 enabling the rotation of the lid 8, and divides the end panel 25' into two portions 10' and 14' associated respectively with a first and a second pair of flaps 52 and 53 located externally of the two longitudinal crease lines 49 and 50.

The flaps 52 of the first pair appear trapezoidal in outline and are hinged each by a longer base to the relative portion 10' of the panel 25' along the respective longitudinal crease line 49 and 50; each flap 52 is separated from the adjoining flap 53 by an oblique notch of substantially triangular shape and terminates at the end remote from the notch 54 in a right edge 77 disposed perpendicular to the longitudinal axis 41.

Each of the second flaps 53 is trapezoidal in outline, hinged by a shorter base to the relative portion 14' of the panel 25' along the respective longitudinal crease line 49 and 50 and comprising a right edge 55 remote from the notch 54 aligned with a relative transverse crease line 46; the longer base appears as an oblique edge 56 that forms a predetermined angle Al with the right edge 55.

The first intermediate panel 27' is associated in like manner with a third pair of flaps 57 located externally of the longitudinal crease lines 49 and 50, each hinged to the panel 27' along a line 58 coinciding with the relative longitudinal crease line 49 and 50 and separated from the transverse crease line 47 bordering the central panel 24' by a predetermined longitudinal distance L. Each flap 57 is separated from the edge 55 of the adjoining second flap 53 by a cut 59, also by a substantially triangular oblique notch 60 of which one vertex coincides with one end of the cut 59, and delimited further by an outer edge 61 disposed parallel to the longitudinal crease lines 49 and 50, and on the side opposite the cut 59 by an oblique edge 62 that forms a predetermined angle A1 with the hinge 58. Similarly, the central panel 24' is associated with a pair of lateral panels 26' positioned externally of the longitudinal crease lines 49 and 50 which together with the central panel 24' are pierced transversely across the full width of the blank by a line 63 constituting the aforementioned line of separation between the lid 8 and the container 6.

The pierced line 63 divides and delineates two portions 9' and 13' of rectangular outline on the central panel 24' and two portions 11' and 15' of trapezoidal outline on each lateral panel 26'.

The second intermediate panel 28' is associated with a pair of flaps 64 located externally of the longitudinal crease lines 49 and 50, appearing trapezoidal in shape and hinged along the selfsame crease lines 49 and 50 by way of the longer bases. The two flaps 64 combine with the intermediate panel 28' and with the end flap 51 to afford a free longitudinal extremity 65 extended from the main portion 42, which is delimited and separated from the appendage 43 by a continuous punched line 66.

The appendage 43 skirts the borrowed extremity 65 peripherally along the continuous punched line 66 and is joined to the two lateral panels 26' along the aforementioned transverse line 44 by way of the two lateral arms 37', which are rendered distinct in their turn by the longitudinal crease lines 49 and 50 from a transverse panel 32' that constitutes the endmost part of the blank and coincides with the breast piece 32 of the frame 29.

Each arm 37' is delimited at the end remote from the corresponding panel 26' by an edge 67 parallel to the interconnecting crease line 44 and of length marginally less than the distance L aforementioned, also by an oblique edge 68 forming an angle with the transverse edge 67 that is equivalent to 180° minus the angle denoted A1.

The arms 37', lateral panels 26' and first flaps 52 are bordered laterally by relative edges 69, 70 and 71 extending parallel to the longitudinal axis 41.

In addition, the arms 37' are proportioned with a longitudinal dimension substantially identical to the longitudinal dimension of the panels 26' and a transverse dimension, apart from the portion that skirts the relative flap 64, substantially equal to the difference between the transverse dimension of one panel 26' and the transverse dimension of one first flap 52.

The appendage 43 will ultimately be bent double over the main portion 42 along the interconnecting crease line 44 and fixed to the surfaces of the portions 9' and 11' directed toward the inside of the packet 1.

Thereafter, the first and second flaps 52 and 53 on either side, and each lateral panel 26' together with a relative arm 37' bent double and fixed to the respective lateral portion 11', will be bent at right angles to the end panel 25' and the central panel 24' and overlapped by rotating the panels 25' and 24' about the intermediate panel 27' toward one another, whilst the third flaps 57 are bent inwards at right angles and brought thus into contact with the inward facing surfaces of the adjoining second flaps 53.

Figure 3:
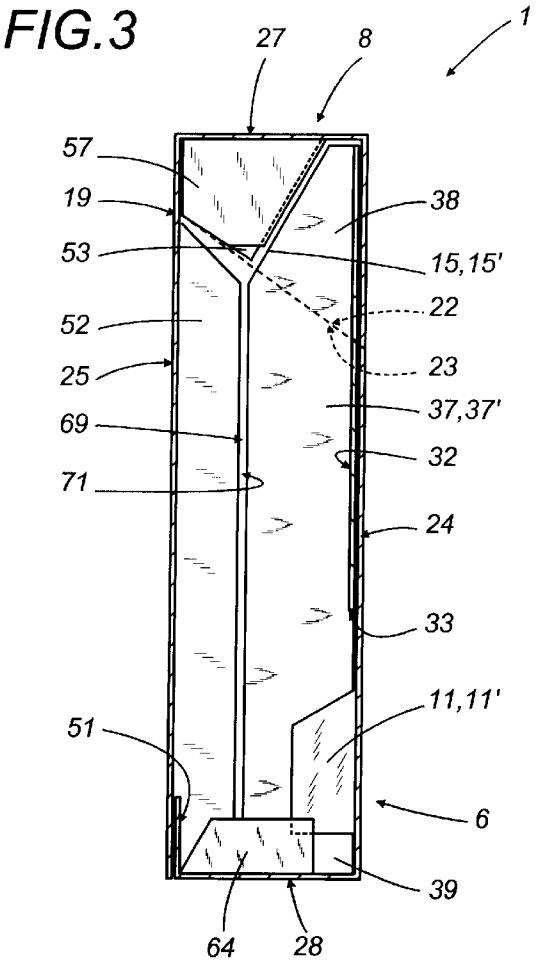
FIG. 3 is a longitudinal section taken through the wrapper of FIG. 2, viewed with the lid in the closed position.

Observing FIG. 3, it will be seen that the first flap 52 and the arm 37' on each side are caused to overlap with the corresponding portion 11' of the lateral panel 26', adjoining though not overlapping one another, whereas the second flap 53 and third flap 57 are overlapped both with one another and with the corresponding portion 15' of the panel but make no contact with the respective arm 37'.

Finally, the second intermediate panel 28' will be bent at right angles to the central panel 24' to provide the bottom 28 of the wrapper 5, whilst the end flap 51 and the adjoining flaps 64 are bent at right angles to the panel 28' and placed in contact with the inside surfaces presented respectively by the corresponding portion 10' of the end panel 25' and by the relative arms 37', thus providing the end folds of the bottom 28.

The blank 40 is obtained, advantageously from the standpoint of cost, by cutting a relatively short length of the selected continuous strip material (not illustrated). This is due essentially to the fact that the bottom 28 and the relative end folds are cut from the same longitudinal portion of the length of strip (not illustrated) that provides the frame 29.

Figure 6:
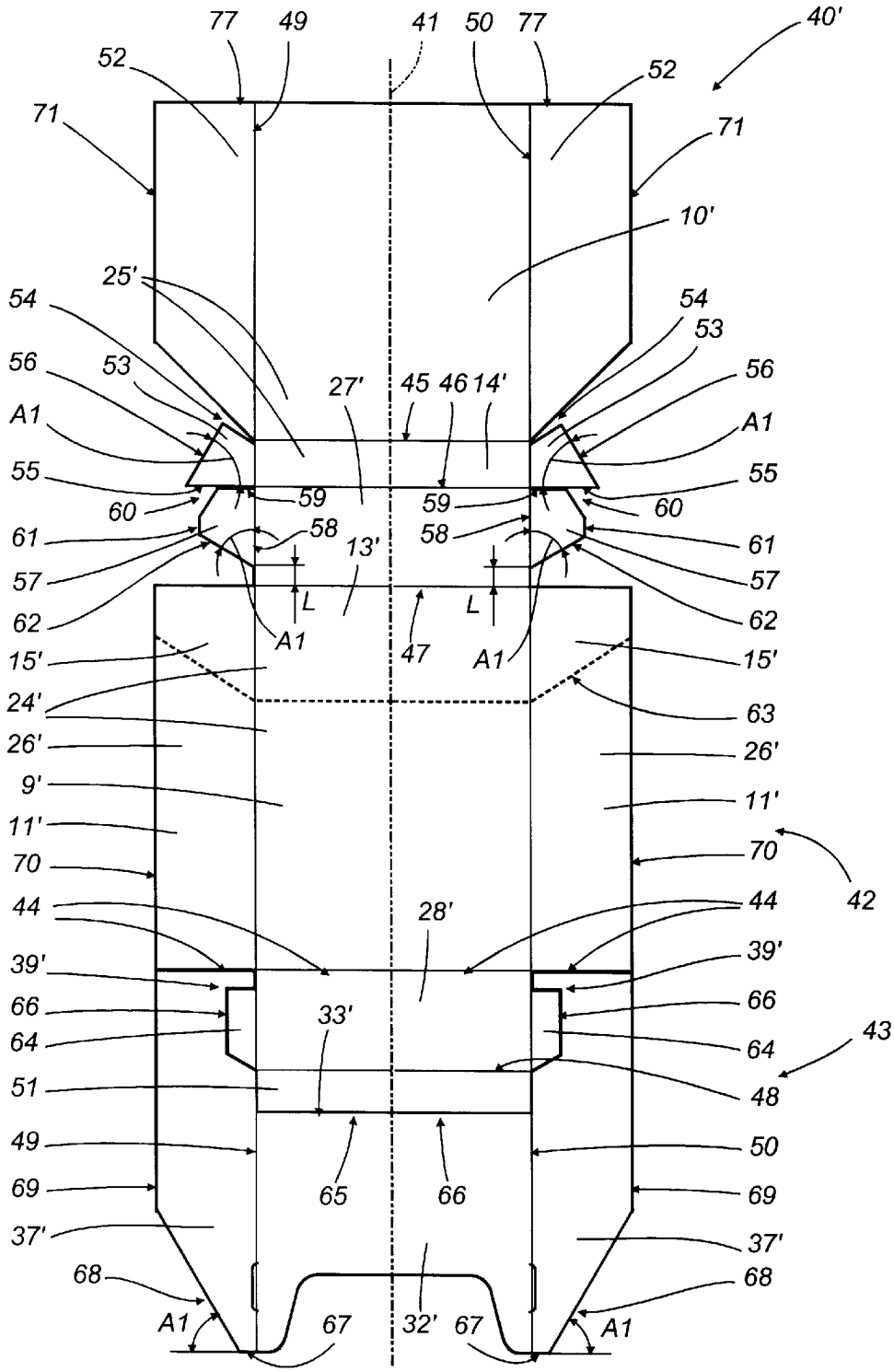
FIG. 6 shows a plan view of the diecut blank with integral frame used to manufacture the wrapper of FIG. 5.

The blank 40' of FIG. 6 differs only in small measure from the blank 40 of FIG. 4, and accordingly the parts are indicated with the same reference numbers as used to denote the corresponding parts of the blank 40 described above. More exactly, the second blank 40' differs from the first blank 40 in that the transverse dimension of the first flap 52 and of the arm 37' is substantially the same as the transverse dimension of the lateral panel 26', i.e. the edges 69, 70 and 71 are aligned longitudinally on each side. Thus, the flaps 52 and the arms 37' overlap fully in the finished wrapper 5 and combine with the relative portions 11' of the two lateral panels 26' to produce a flank face 11 of thickness three times the thickness of the blank 40', with clear advantages in terms of the rigidity afforded by the container 6.

A rigid wrapper obtained from a blank according to the invention can also be used advantageously to fashion a carton containing a plurality of packets of cigarettes.

Figure 7:
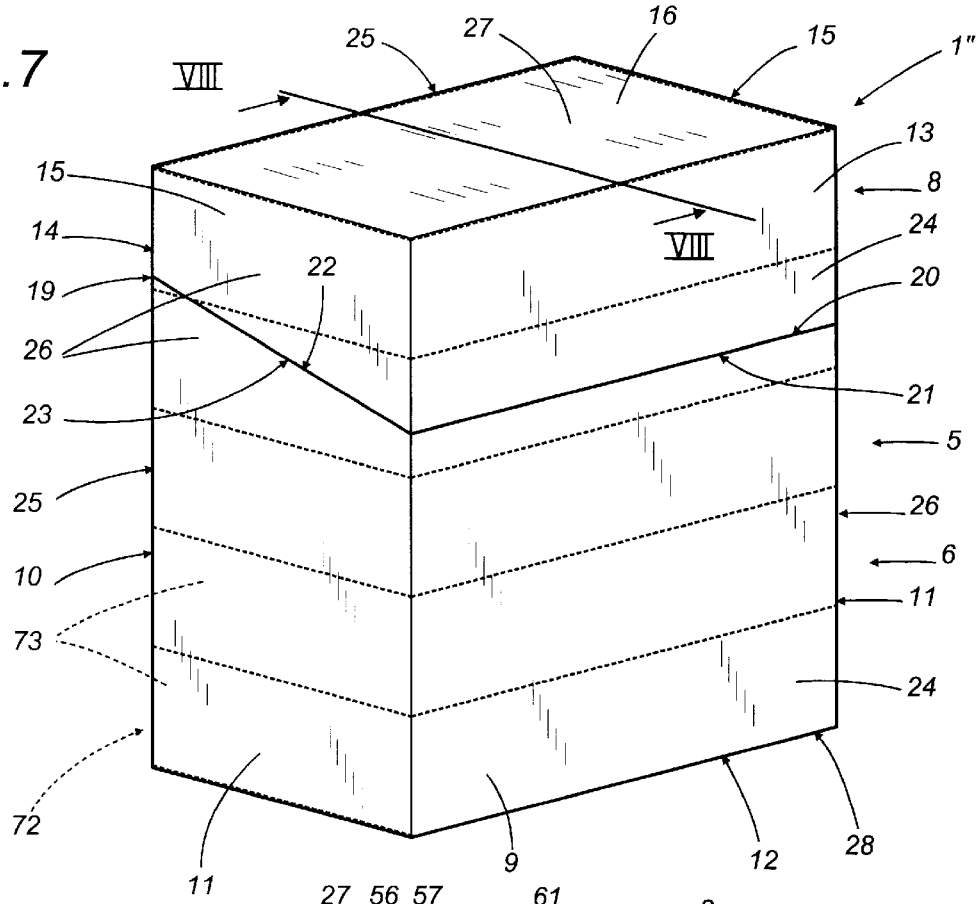
FIG. 7 illustrates a third embodiment of the rigid wrapper with hinged lid according to the present invention, viewed in perspective.

In FIG. 7 of the drawings, 11" denotes a rigid carton containing an ordered group 72 of packets 73 of cigarettes stacked in such a way that the front face of the one is breasted in contact with the rear face of the next.

Figure 9:
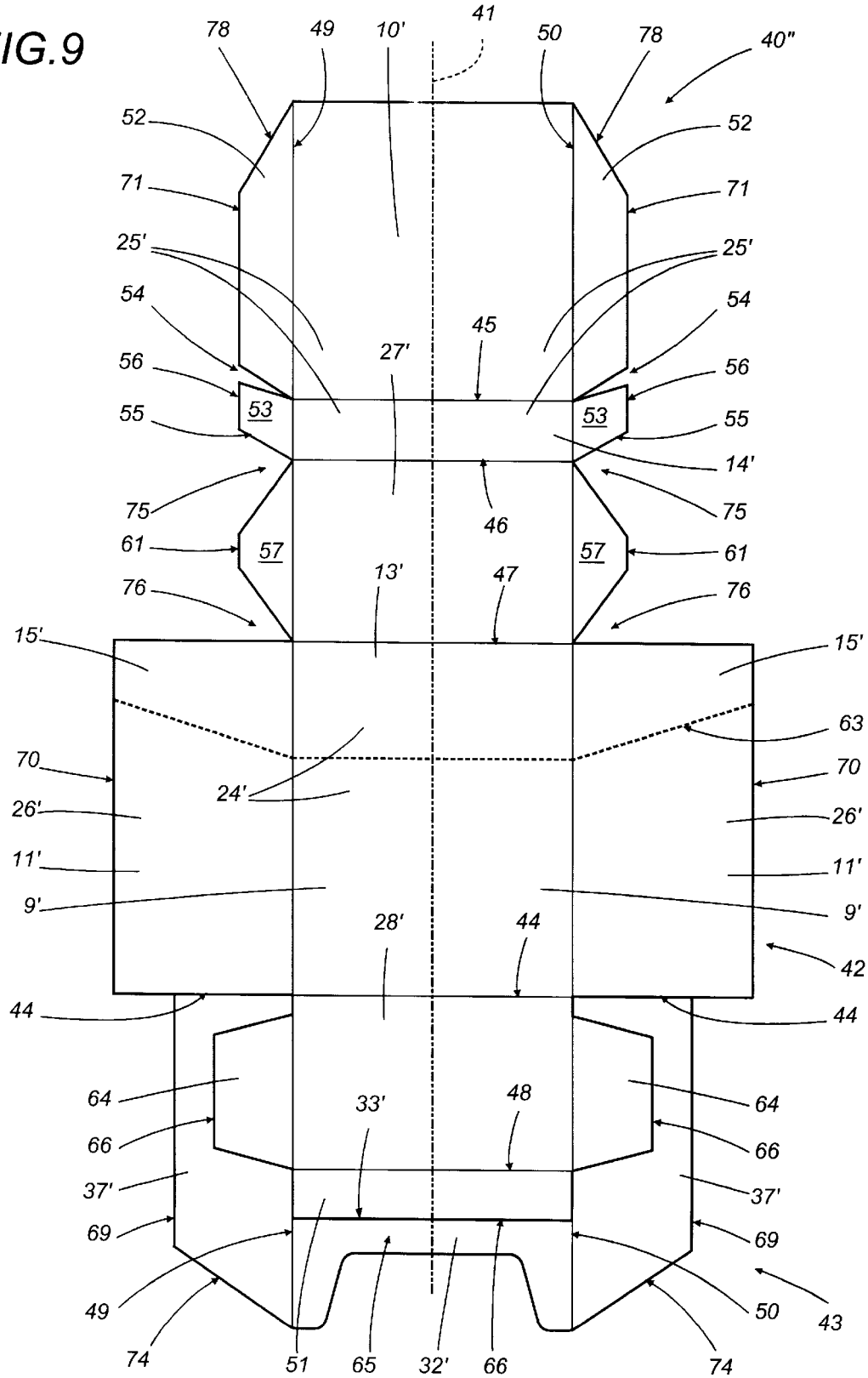
FIG. 9 shows a plan view of the diecut blank with integral frame used to manufacture the wrapper of FIG. 7.

The carton 1" comprises a rigid outer wrapper 5 of box construction entirely similar in shape and in design to that of FIGS. 2 and 5, and accordingly the parts of the wrapper 5 and the relative blank, denoted 40" in FIG. 9, are indicated using the same reference numbers as utilized for the packets 1 and 1' already described.

The packets 73 are disposed in the wrapper 5 with the front and rear faces parallel to the bottom 28 and the top and bottom end faces in contact with the flanks 26.

The carton blank 40" differs from the blank 40 of FIG. 4 not only in terms of dimensions but also in that the arms 37', the bottom end fold flaps 64 and the first, second and third flaps 52, 53 and 57 are shaped differently. In particular, the arms 37' terminate at the ends remote from the two lateral panels 26' in two entirely oblique edges 74, whilst the trapezoidal third flaps 57 are separated from the adjoining second flaps 53 and from the lateral panels 26' respectively by substantially triangular notches 75 and 76; also, the outer edges 56 and 61 of these same flaps 53 and 57 are aligned with the edges 71 of the first flaps 52, and each first flap 52 terminates at the end remote from the triangular notch 54 in an oblique edge 78.

Figure 8:
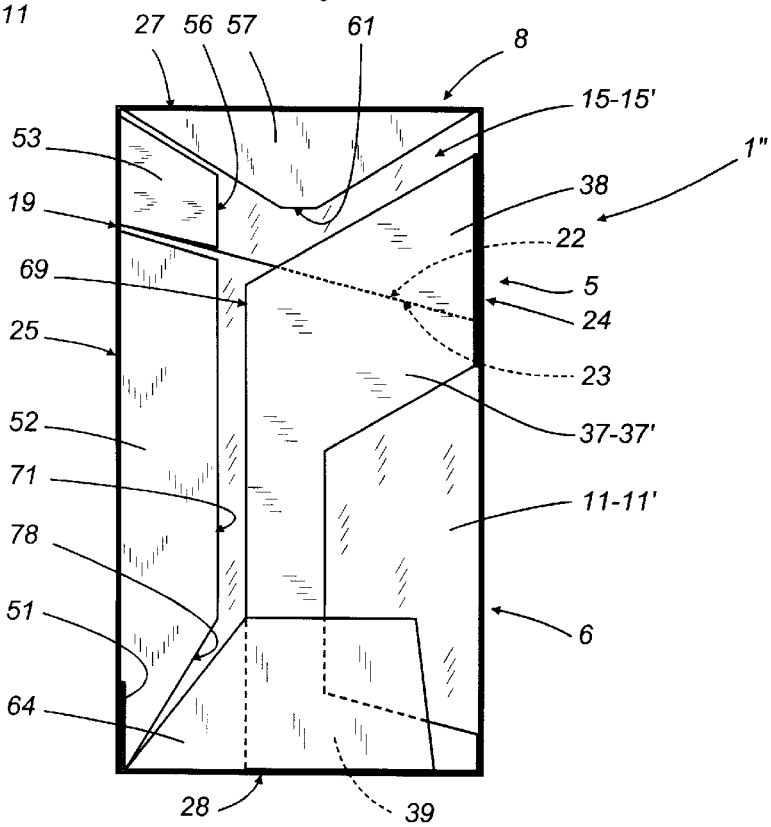
FIG. 8 is the section through VIII—VIII in FIG. 7.

Observing FIG. 8, it will be seen that the various flaps 52, 53, 57 and 64 are shaped and proportioned such that in the finished wrapper 5, the flaps 52 and 64 of the container and the flaps 53 and 57 of the lid are disposed adjoining one another but not overlapping. Moreover, still referring to FIG. 8, the lid flaps 53 and 57 and the arms 37' are shaped and proportioned in such a manner that when united with the relative portions 15' to fashion the flank face 15 they make no contact with the corresponding arms 37'.

In an alternative embodiment (not illustrated) of the blank 40" shown in FIG. 9, the first flaps 52 and arms 37' could exhibit a transverse dimension substantially identical to the transverse dimension of the lateral panels 26', i.e. in the same manner as already described with reference to FIG. 6, so that the longitudinal edges 69, 70 and 71 will be mutually aligned on either side. In the finished wrapper 5, accordingly, the first flaps 52 and the arms 37' will overlap completely and combine thus with the corresponding portions 11' of the lateral panels 26' to produce a flank face 11 of thickness substantially three times that of the blank 40", with obvious advantages in terms of the rigidity afforded by the container 6.

What is claimed is:

1. A rigid wrapper with hinged lid for tobacco products, of the type presenting a front, a back, two flanks, a top and a bottom, and comprising a container and a lid both of cupped embodiment hinged together along respective rear edges, also a reinforcing frame positioned partly inside the cupped container and secured thus to a front face and to two flank faces of the selfsame container; wherein the wrapper is fashioned from a flat diecut blank of substantially rectangular shape with a predominating longitudinal axis that comprises, arranged along the longitudinal axis, a main portion providing the container and the lid, and a longitudinal appendage providing the frame; the main portion of the blank comprises an end panel providing the back, a first intermediate panel providing the top, a central panel providing the front and two lateral panels providing the flanks of the wrapper; and the appendage is substantially U-shaped, appearing as two lateral arms and a transverse panel of which the arms are hingedly attached to the respective lateral panels of the main portion, and disposed in such a way as to circumscribe a free longitudinal extremity of the main portion that affords a second intermediate panel providing the bottom, and two side flaps and a longitudinal end flap functioning as end folds by which the bottom is secured.

2. A wrapper as in claim 1, wherein the two arms and the second intermediate panel are hinged along a common transverse crease line to the lateral panels and to the central panel respectively.

3. A wrapper as in claim 1, wherein the appendage and the free longitudinal extremity are delimited and separated by a continuous punched line.

4. A wrapper as in claim 1, wherein the diecut blank exhibits two longitudinal crease lines by which the central panel is divided from the lateral panels, the second intermediate panel from the side flaps and the arms from the transverse panel, and further comprises a first and a second pair of flaps disposed externally of the longitudinal crease lines and associated with the end panel.

5. A wrapper as in claim 4, wherein the transverse dimensions of the lateral panels, the arms and the first flaps are substantially the same, and substantially identical to the transverse dimensions of the flanks.

6. A wrapper as in claim 5, wherein the flank faces of the container are fashioned as a result of the lateral panels, the arms and the first flaps being brought into overlapping contact one with another.

7. A wrapper as in claim 4, wherein the transverse dimension of the arms is substantially equivalent to the difference between the transverse dimension of the lateral panels and the transverse dimension of the first flaps.

8. A wrapper as in claim 7, wherein the flank faces of the container are fashioned as a result of the arms and the first flaps being brought into overlapping contact with the lateral panels but not into overlapping contact one with the other.

9. A wrapper as in claim 4, fashioned from a diecut blank comprising a third pair of flaps hinged to the first intermediate panel along the two longitudinal crease lines, wherein the second flaps and the third flaps are shaped in such a way as to enter into overlapping contact with one another and with the respective lateral panels while making no contact with the respective arms.

10. A wrapper as in claim 4, fashioned from a diecut blank comprising a third pair of flaps hinged to the first intermediate panel along the two longitudinal crease lines, wherein the second flaps and the third flaps are shaped in such a way as to enter into overlapping contact with the respective lateral panels without overlapping one another and making no contact with the respective arms.

11. A wrapper as in claim 1, wherein the diecut blank exhibits a pierced line extending transversely across the central panel and the lateral panels, occupying the full width of the blank and serving to establish a line of separation between the lid and the container.

12. A wrapper as in claim 1, wherein the transverse panel coincides with a breast piece of the frame.

13. A wrapper as in claim 1, wherein the longitudinal axis of the blank is an axis substantially of symmetry.

14. A wrapper as in claim 1, constituting the wrapper of a packet of cigarettes.

15. A wrapper as in claim 1, constituting the wrapper of a carton of cigarettes.

* * * * *